US007815013B2

(12) United States Patent
Griffith

(10) Patent No.: US 7,815,013 B2
(45) Date of Patent: Oct. 19, 2010

(54) ENERGY ABSORBER FOR PERSONAL FALL ARRESTOR

(75) Inventor: Richard R. Griffith, New Hartford, NY (US)

(73) Assignee: Sturges Manufacturing Co., Utica, NY (US)

( * ) Notice: Subject to any disclaimer, the term of this patent is extended or adjusted under 35 U.S.C. 154(b) by 1088 days.

(21) Appl. No.: 11/237,157

(22) Filed: Sep. 28, 2005

(65) Prior Publication Data

US 2007/0068730 A1 Mar. 29, 2007

(51) Int. Cl.
*A62B 35/00* (2006.01)

(52) U.S. Cl. ..... 182/3; 182/18

(58) Field of Classification Search ..... 182/3, 182/18

See application file for complete search history.

(56) References Cited

U.S. PATENT DOCUMENTS

| | | | | |
|---|---|---|---|---|
| 2,929,412 | A * | 3/1960 | Abendroth | 139/385.5 |
| 3,444,957 | A | 5/1969 | Ervin, Jr. | |
| 3,861,744 | A * | 1/1975 | Yamada et al. | 297/472 |
| 4,618,026 | A | 10/1986 | Olson | |
| 4,856,837 | A * | 8/1989 | Hammersla, Jr. | 294/74 |
| 5,564,476 | A | 10/1996 | Golz | |
| 5,598,900 | A | 2/1997 | O'Rourke | |
| 6,006,700 | A | 12/1999 | Cox | |
| 6,085,802 | A * | 7/2000 | Silberberg | 139/387 R |
| 6,199,597 | B1 * | 3/2001 | David | 139/383 R |
| 6,533,066 | B1 | 3/2003 | O'Dell | |
| 6,851,516 | B2 | 2/2005 | Petzl et al. | |
| 2006/0027277 | A1 * | 2/2006 | Jennings et al. | 139/408 |

OTHER PUBLICATIONS

Canadian Standards Association; Energy absorbers and lanyards; Z259.11-05; Feb. 2005; 42 Pages.

Canadian Standards Association; Shock Absorbers for Personal Fall Arrest Systems; CAN/CSA-Z259.11-M92 (Reaffirmed 1998); Mar. 1992; 20 Pages.

American Society of Safety Engineers; American National Standard Safety Requirements for Personal Fall Arrest Systems, Subsystems and Components; Z359.1-1992 (R1999); May 1999; 107 Pages.

* cited by examiner

*Primary Examiner*—Alvin C Chin-Shue
(74) *Attorney, Agent, or Firm*—Hiscock & Barclay, LLP; Thomas J. Wall; R. S. Rosenholm

(57) ABSTRACT

An energy absorber for use in a personal fall arresting system. The absorber contains upper and lower webbings which are each two ply members. The back ply of the upper webbing is mounted adjacent to the face ply of the lower webbing with said webbing being of about equal length and width. Exterior tear elements run back and forth sinusoidally between attachment points on the face ply of the upper webbing and the back ply of the lower webbing. Interior tear elements run back and forth sinusoidally between attachment points on the back ply of the upper webbing and the top ply of the lower webbing.

14 Claims, 3 Drawing Sheets

ENERGY ABSORBER FOR PERSONAL FALL ARRESTOR

FIELD OF THE INVENTION

This invention relates to an energy absorbing device suitable for use in a personal fall arresting system.

BACKGROUND OF THE INVENTION

Workers who are obligated to work in high places such as on scaffolding, window ledges, and the like typically wear a body harness and/or a safety belt which is secured by a lanyard to some type of available anchorage. In the event the worker falls from a relatively high perch, he or she can reach a very high velocity in a matter of seconds. Depending upon the length of the lanyard, a falling worker's descent can be abruptly terminated causing serious bodily harm to the worker. Various shock absorbing devices have been developed over the years to decelerate a worker's fall, and thus cushion the resulting impact shock. The shock absorber is typically made part of the lanyard connecting the worker's body harness or belt to an anchorage. One prevalent type of shock absorber is disclosed in U.S. Pat. No. 3,444,957 to Ervin, Jr. that involves a length of high strength webbing that is folded over itself a number of times with the adjacent folds being stitched together. The stitching is adapted to tear apart when placed under a given dynamic load to absorb the energy generated by the fall. This type of absorber is relatively lightweight, compact, and thus easily portable as well as being easily retrofitted into existing safety systems. This type of shock absorber will herein be referred to as a tear away type of energy absorber.

An American National Standard Z359 relating to personal fall arrest systems was issued in 1992 and revised in 1999. The standard addressed different safety systems and various methods for arresting falls of workers from high places. The American National Standard is consistent in the most important features with the standards of other countries including those of the Canadian Standard CAN/CSA Z259.11-05. Most, if not all, tear away absorbers in present day usage cannot consistently pass the dynamic drop test set out in the United States National Standard.

SUMMARY OF THE INVENTION

It is therefore an object of the present invention to improve personal fall arrest systems.

It is a further object to improve tear away shock absorbers used in personal fall arrest systems.

It is still a further object of the present invention to provide a web type tear away shock absorber that can pass the dynamic drop tests set out in the American and Canadian National Standards covering safety requirements for personal fall arrest systems.

Another object of the present invention is to provide a tear away shock absorber for use in a personal fall arrest system that is simple in design, lightweight, flexible, and easily integrated into existing systems.

These and other objects of the present invention are attained by an energy absorber suitable for use in a personal fall arresting system that includes upper and lower two-ply webbings. Each webbing has a face ply and a back ply extending along the length of the webbing. The webbings are mounted one over the other with the back ply of the upper webbing being adjacent to and aligned with the face ply of the lower webbing. Exterior tear elements are arranged to run back and forth sinusoidally between attaching points located on the face ply of the upper webbing and the back ply of the lower webbing. Interior tear elements are arranged to run back and forth sinusoidially between attachment points located on the back ply of the upper webbing and the face ply of the lower webbing. The tear elements are designed to tear away decelerating the worker's rate of fall and thus remove the shock at impact.

BRIEF DESCRIPTION OF THE DRAWINGS

For a better understanding of these and other objects of the subject invention, reference will be made in the disclosure below to the accompanying drawings, wherein.

DETAILED DESCRIPTION OF THE INVENTION

Figures 1, 2:
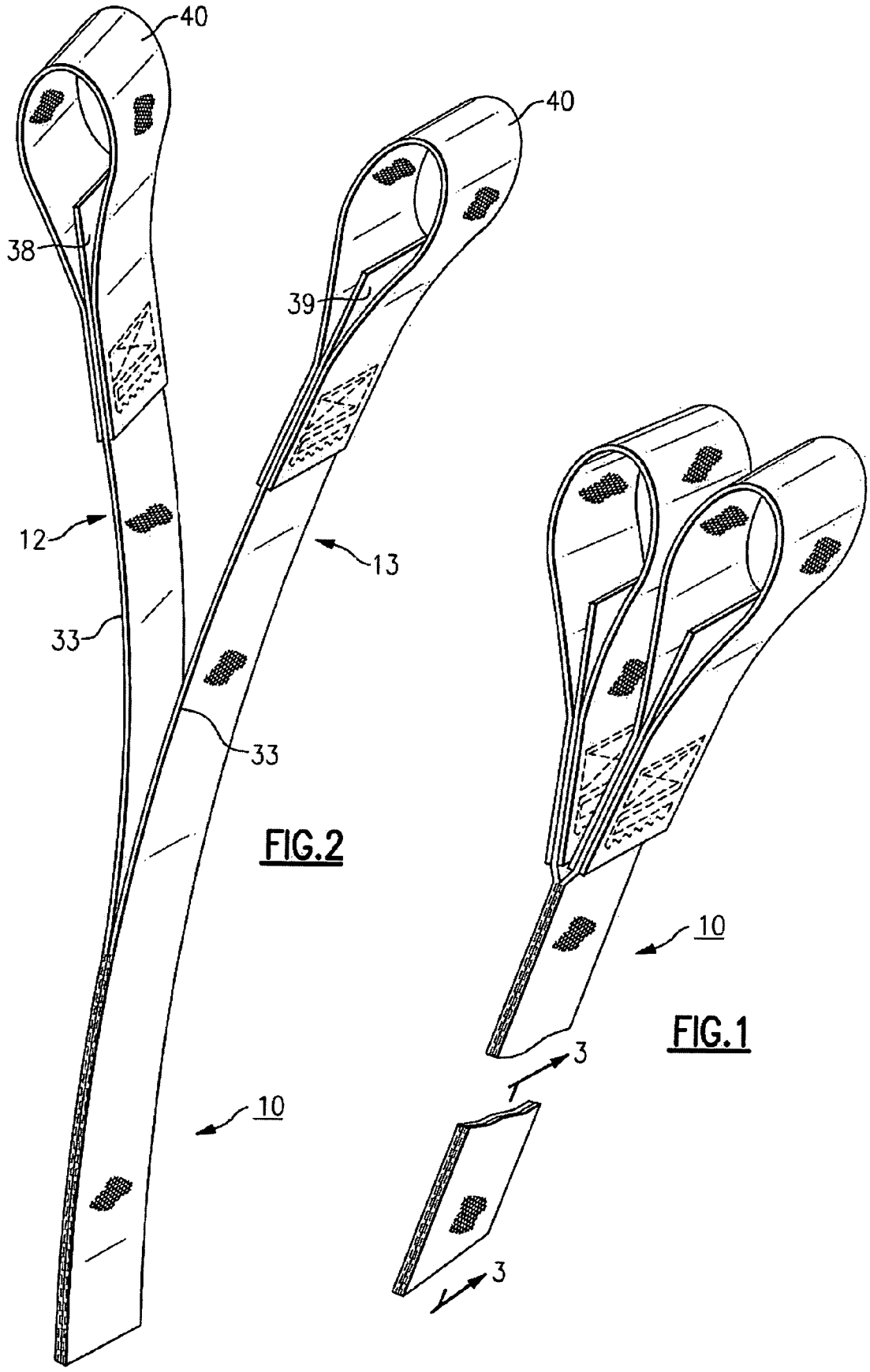
FIG. 1 is a partial perspective view illustrating a tear away web type shock absorber that embodies the teachings of the present invention.
FIG. 2 is a perspective view of the shock absorber shown in FIG. 1, further illustrating the upper and lower webbings starting to separate under load.
Figure 3:
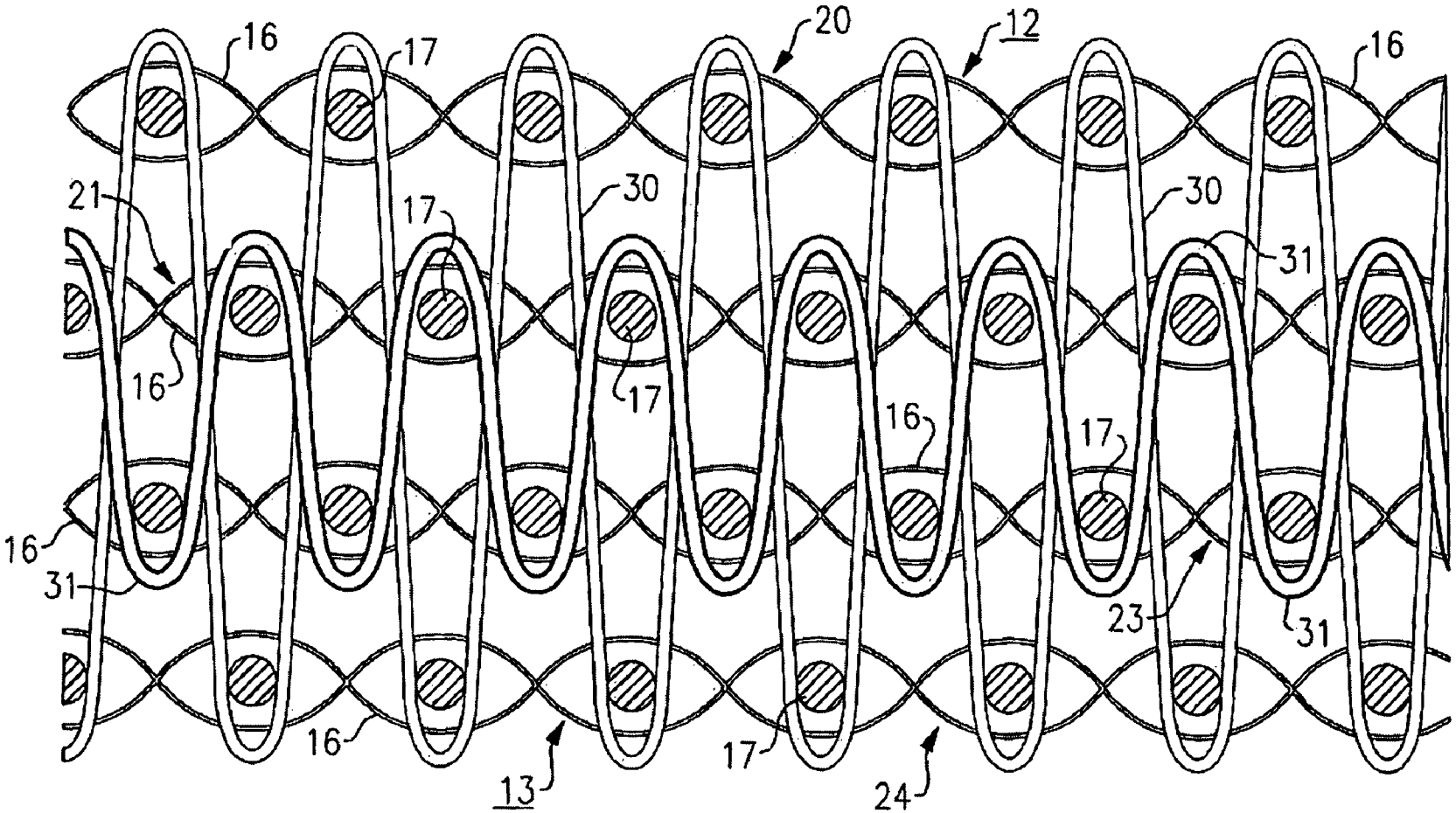
FIG. 3 is an enlarged partial sectional view taken along lines 3-3 in FIG. 1 further showing the construction of the shock absorber.

Turning now to FIGS. 1-3, there is illustrated a tear away type energy absorber, generally referenced 10, that embodies the teachings of the present invention. The absorber contains a pair of two ply webbings that includes an upper webbing 12 and lower webbing 13. The two webbings are woven from high tenacity polyester yarns with each ply including a series of longitudinally extended ends having a series of warps 16 spaced along its length and filling yarn or wefts 17 that pass laterally throughout the warps to transverse the width of the yarn.

The upper webbing contains a face ply 20 and a back ply 21. The lower webbing similarly includes a face ply 23 and a back ply 24. The wefts contained in the back ply of each webbing are arranged in assembly so that they are located about midway between the wefts contained in the face ply of each webbing. The upper and lower webbing are of the same length and width. In assembly, the two webbings are superimposed in alignment one over the other with the back ply of the upper webbing being mounted adjacent to the face ply of the lower webbing. As illustrated in FIG. 3, the wefts in the two face plys are placed in commonly shared vertical rows and the wefts in the two back plys are also placed in commonly shared vertical rows with the rows containing the back ply wefts being located about midway with respect to the rows containing the face ply rows.

The two pieces of webbing are woven together using a series of binders that are formed by continuous strands of tear elements. The tear elements include what will herein be referred to as an exterior tear element 30 and interior tear element 31. The tear elements in this embodiment are fabricated of high tenacity polyester yarns, although other suitable yarns such as nylon or the like having similar properties may be used without departing from the teachings of the present invention. The exterior binder runs back and forth in a sinusoidal manner between attachment points on the face ply of the upper webbing and the back face of the lower webbing. The interior binding runs back and forth in a sinusoidal configuration between attachment points on the back ply of the upper webbing and the face ply of the lower webbing. As illustrated in FIG. 3, the laterally extended wefts in each of the ply serve as the attachment points for both binders. The tensile strength of the two binders is less than that of the wefts and as will be explained in greater detail below, the binders will tear out under load before the wefts will rupture. A lock stitch 33 (FIG. 2) is included along the longitudinal knitted edge of each webbing.

The two opposing ends 38 and 39 of the energy absorber 10 will typically be provided with connectors for attaching the energy absorber to a personal fall arrest system. In assembly, the energy absorber will be placed in series with a lanyard for coupling the worker harness or safety belt to a suitable anchorage such as a stationary structural element having sufficient strength to arrest a worker's descent in the event of a fall. The lanyard provides sufficient length to permit the worker to move about with a reasonable amount of freedom. In the event of a fall, the lanyard will play out until it becomes taut at which time the dynamic load of the falling worker is taken up by the energy absorber whereupon the binders begin to tear away absorbing the kinetic energy generated by the fall. The rate of the fall is thus decelerated, lowering the force acting upon the worker's body as the fall is being arrested.

Applicant, in order to insure that it is in compliance with the National Standards of the United States and Canada, has constructed a test stand for dynamically testing sample absorber specimens of the type described above. As illustrated in FIGS. 1 and 2, the test specimens were equipped at each end with high strength non-elastic loop connectors 40 and 41 that are sewn into the ends of the absorber. The connectors will not pull out or elongate when experiencing dynamic load well in excess of one thousand pounds.

Figure 4:
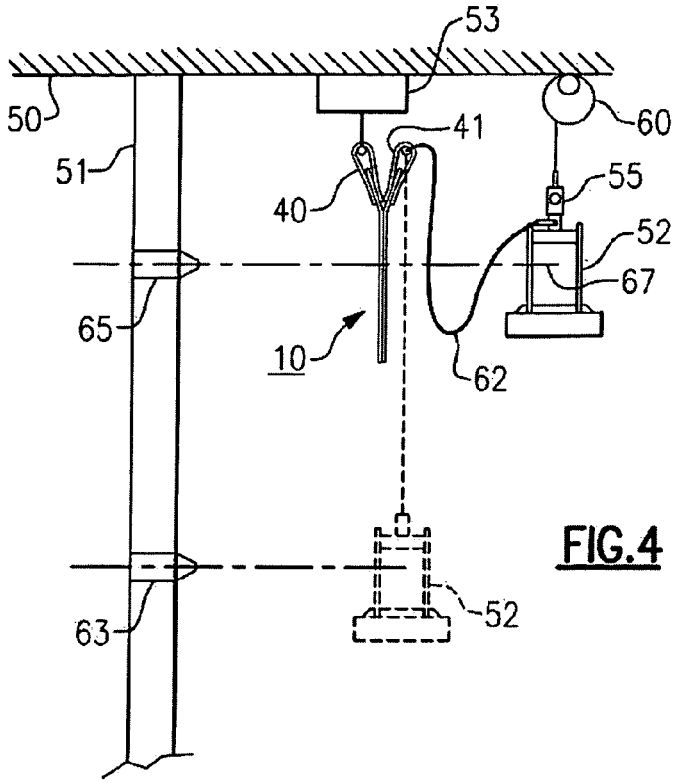
FIG. 4 is a partial front elevation of a test strand for performing dynamic drop tests upon specimens of shock absorbers embodying the teachings of the present invention.

With further reference to FIG. 4, the test stand contains an anchorage consisting of a horizontal cross beam 50 supported upon a pair of spaced apart vertical columns, one of which is depicted at 51. Although not shown, the cross beam is suspended above a drop pit containing a deep layer of sand. During a test, the two loops of the energy absorber are initially provided with shackles and the shackle of one loop connected to an anchorage point. A ten pound weight is suspended from the other loop and the distance between the two loop fold over points recorded. A load cell 53 is securely mounted upon the center of the crosspiece and one of the energy absorber loops is attached to the load cell by a suitable eyebolt.

An air activated quick release mechanism 55 is connected to a two hundred and twenty pound weight 52 by means of a suitable shackle. The weight is raised by a hoist 60 to a point immediately below the crossbeam and the weight then connected by a test lanyard 62 to the other loop connector on the test specimen. The weight is next lowered by the hoist until the test weight is supported entirely by the test lanyard. A first laser 63 which is adjustably mounted on one of the support columns is vertically adjusted so that its horizontal beam illuminates a horizontal line 67 located on the weight. A second laser 65, which is also vertically adjusted upon the column, is set six feet above the first laser and the weight is lifted by the hoist until the beam of the second laser illuminates the line on the weight.

At this time, the quick disconnect mechanism is released and the weight allowed to drop, thereby activating the energy absorber, whereupon the tear element breaks away, decelerating the falling weight and bringing the weight to a controlled halt. The distance between the foldover points of the two loops upon the played out energy absorber is then measured and the elongation of the absorber is calculated by subtracting the initially recorded foldover distance prior to the absorber being activated and the final foldover distance measurement. The elongation tear length of the energy absorber is recorded and the peak load and average load data are graphically provided by the load cell readout.

To meet the dynamic performance standards set out by the American National Standards Institute (ANSI) for an energy absorber, the energy absorber must not elongate beyond forty-two inches from its initial length and the standard maximum arresting force shall not exceed nine hundred pounds.

Figure 5:
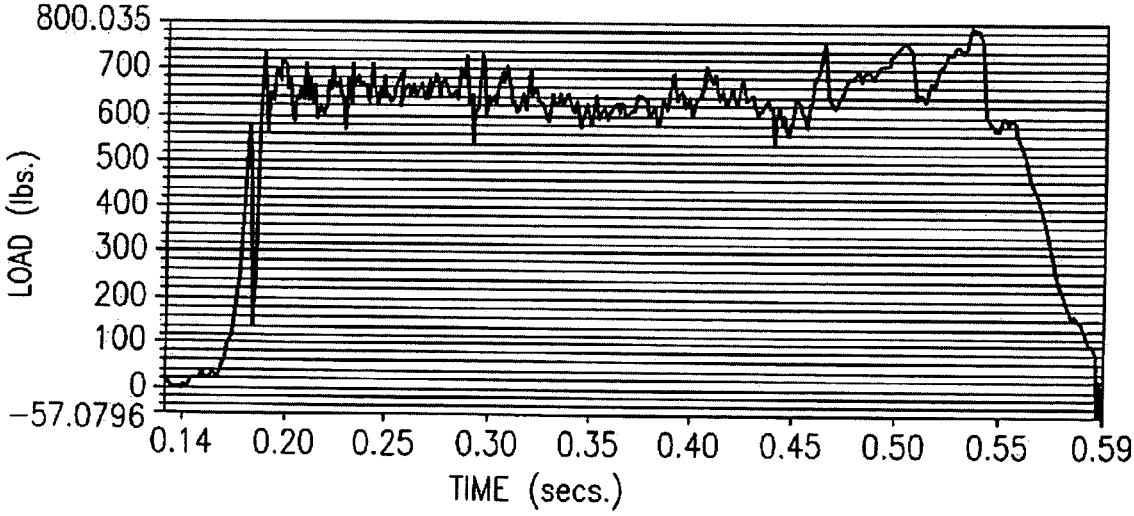
FIG. 5 is a graph plotting load against time illustrating a typical test result relating to an energy absorber of the present invention.

A number of test specimens containing the double two ply webbing arrangement described above having interior and exterior bindings were tested in the noted test stand in an effort to identify an energy absorber that will consistently meet the dynamic performance tests set out by ANSI. One energy absorber configuration was identified that consistently met the standards for a dynamic drop test. Each of the webbings had a length of about 24.0 inches and a width of about 1.75 inches. In this configuration, each face and back ply of either the upper or lower webbing layer contained fifty-two ends of 1,300 denier two-ply high tenacity polyester yarns. The wefts contained in each ply were also fabricated of 1,300 denier high tenacity polyester yarns. Each webbing further contained twenty-five ends of exterior binders and twenty-five ends of interior binders. The binders were fabricated of 1,000 denier high tenacity polyester yarns. FIG. 5 is a graphic representation showing a typical test result of an energy absorber constructed as noted above that was subjected to a dynamic performance test conducted in accordance with ANSI Z359.1 wherein at the time of testing, the relative humidity was 43% and an ambient temperature of 83° F. The graph plots the load in pounds exerted upon the specimen against time. The specimen elongated 31.25 inches with a peak load of 793.14 pounds and an average loading of 644.50 pounds. The test results are clearly well within those prescribed in ANSI safety requirements for fall arrest systems.

It was found through further testing that performance of an energy absorber constructed in accordance with the teachings of the present invention was further enhanced by coating the interior and exterior binders with a material that improves the binder's yarn on yarn abrasion resistance as well as resistance to exposure to temperature extremes and to moisture. One such coating material that performed well in practice was a siloxane-based overlay that formed a durable polymeric network upon the binders that is commercially available from Performance Fibers, Inc. under the trade name SEAGARD. It is believed that other polymer materials which have a high lubricity will perform equally as well in practice in avoiding high yarn on yarn abrasion. In a further embodiment of the invention, the wefts of the two webbings are also coated with the above noted material to further enhance the performance of the energy absorber.

While this invention has been particularly shown and described with reference to the preferred embodiment in the drawings, it will be understood by one skilled in the art that various changes in its details may be effected therein without departing from the teachings of the invention.

What is claimed is:

1. An energy absorber for use as part of a personal fall arresting system that includes:

upper and lower two-ply webbings, each webbing having a face ply and a back ply extending along a length of each said webbing, said webbings mounted one over the other with said back ply of said upper webbing being adjacent to said face ply of said lower webbing, and wherein each said ply including a series of warp yarns spaced along its length and a series of weft yarns passing laterally through said warp yarns and wherein said weft yarns of each said face ply are arranged and located substantially midway between said weft yarns of each said back ply within a same webbing and between adjacent webbings;

exterior tear elements running back and forth sinusoidally between attachment points on weft yarns of said face ply of said upper webbing and adjacent weft yarns of said back ply of said lower webbing; and interior tear elements running back and forth sinusoidally between attachment points on weft yarns of said back ply of said upper webbing and adjacent weft yarns said face ply of said lower webbing, and wherein said tear elements are fabricated of a material that is designed to rupture before material fabricating said upper and lower webbings, when the energy absorber is placed under a sufficiently high load.

2. The energy absorber of claim 1, wherein said attachment points are evenly distributed along a width of selected ends of each ply.

3. The energy absorber of claim 1, wherein each tear element is fabricated of a continuous high tenacity polyester yarn.

4. The energy absorber of claim 3, wherein the tear elements are covered with a coating for protecting the tear elements against yarn to yarn wear, temperature extremes, and moisture.

5. The energy absorber of claim 4, wherein said coating is a siloxane-based material.

6. The energy absorber of claim 4, wherein each tear yarn is looped around weft yarns that pass laterally through warp yarns ends contained in said face plys and said back plys of said upper and lower webbings.

7. The energy absorber of claim 6, wherein said tear elements are fabricated of a material having a lower tensile strength than that of said upper and lower webbings, when the energy absorber is placed under a sufficiently high load.

8. An energy absorber for use as a component part of a personal fall arresting system that includes:

a two-ply upper webbing having a face ply and a back ply, each said ply containing uniformly spaced weft yarns that pass laterally through warp yarns located in the plys of said upper webbing;

a two-ply lower webbing having a face ply and a back ply, each said ply containing uniformly spaced weft yarns that pass laterally through warp yarns located in the plys of the said lower webbing;

said webbings being mounted one over the other with the back ply of the upper webbing located adjacent to and in alignment with the face ply of the lower webbing and with the weft yarns in the two back ply being spaced about midway between the weft yarns in the two face plys; the weft yarns of the back ply of the upper webbing being spaced midway between the weft yarns of the face ply of the lower webbing;

a number of continuous exterior tear yarns, each of which runs back and forth over attachment points on weft yarns contained in the face ply of the upper webbing and adjacent weft yarns contained in the back ply of the lower webbing to establish a sinusoidal-shaped exterior binder; and a number of continuous interior tear yarns, each of which runs back and forth over the weft yarns contained in the back ply of the upper webbing and adjacent weft yarns contained in the face ply of the lower webbing to establish a sinusoidal-shaped interior binder;

and in which each of the exterior and interior tear yarns are fabricated from a material having a lower tensile strength than that of materials of said upper and lower two ply webbings.

9. The energy absorber of claim 8, wherein said binders are coated with a coating for reducing yarn to yarn wear and which provides protection against temperature extremes and moisture.

10. The energy absorber of claim 9, wherein said coating is a siloxane-based material that forms a polymeric coating upon said binders.

11. The energy absorber of claim 8, wherein each said ply contains about fifty-two face ends and about fifty-two back ends.

12. The energy absorber of claim 11, wherein each ply contains about twenty-five exterior tear yarns and about twenty-five interior tear yarns.

13. The energy absorber of claim 9, wherein said warp yarns are fabricated of 1,300 denier two-ply high tenacity polyester, weft yarns are 1,300 denier single ply high tenacity polyester and said binders are fabricated of 1,000 denier high tenacity polyester yarns.

14. The energy absorber of claim 9, wherein said weft yarns of said upper and lower webbings are also coated with a coating for reducing yarn to yarn wear and for protection against temperature extremes and moisture.

* * * * *